US005772097A

United States Patent [19]

Hillebrand

[11] Patent Number: 5,772,097

[45] Date of Patent: Jun. 30, 1998

[54] BINDING DEVICE

[75] Inventor: Bernd Anton Hillebrand, Bergrheinfeld, Germany

[73] Assignee: Koenig & Bauer-Albert Aktiengesellschaft, Wurzburg, Germany

[21] Appl. No.: 650,822

[22] Filed: May 20, 1996

[30] Foreign Application Priority Data

May 20, 1995 [DE] Germany ..... 195 18 652.4

[51] Int. Cl.[6] ..... B41F 13/64

[52] U.S. Cl. ..... 227/81; 227/82; 227/85

[58] Field of Search ..... 227/81, 82, 83, 227/84, 85

[56] References Cited

U.S. PATENT DOCUMENTS

| | | | |
|---|---|---|---|
| 2,717,383 | 9/1955 | Stobb | 227/81 |
| 2,722,000 | 11/1955 | Turrall | 227/81 |
| 5,284,466 | 2/1994 | Magnusson et al. | 227/81 X |
| 5,342,032 | 8/1994 | Meier | 227/81 X |
| 5,356,125 | 10/1994 | Hansch et al. | 227/81 X |
| 5,390,905 | 2/1995 | Melchior | 227/81 X |
| 5,464,199 | 11/1995 | Stauber | 227/81 X |

FOREIGN PATENT DOCUMENTS

| | | |
|---|---|---|
| 0 520 967 | 12/1992 | European Pat. Off. . |
| 0 606 555 | 7/1994 | European Pat. Off. . |
| 29 32 757 | 3/1982 | Germany . |

*Primary Examiner*—Joseph J. Hail, III
*Assistant Examiner*—Jay A. Stelacone
*Attorney, Agent, or Firm*—Jones, Tullar & Cooper, P.C.

[57] ABSTRACT

A binding device accomplishes the transverse binding or stapling of product elements in a folding apparatus that is situated downstream from a rotary printing press. One or more binding cylinders are supported for rotation with, and with respect to, a binding cylinder support which is cooperatively positioned with respect to a collection and counter-cylinder. The binding device minimizes vibrations and maintains staple-forming elements within the binding cylinder.

5 Claims, 3 Drawing Sheets

BINDING DEVICE

FIELD OF THE INVENTION

The present invention is designed generally to a binding device. More particularly, the present invention is directed to a device for binding or stapling signatures. Most specifically, the present invention is directed to a device for binding signatures in a folding apparatus of a rotary printing press. At least one binding cylinder is provided with a suitable number of stapler heads. These stapler heads are provided with staples and operate to insert the staples through a signature prior to its being folded. One or more of these binding cylinders are supported for rotation on, and with respect to, a cutting and binding cylinder support. The rotational directions of this binding cylinder support, the individual binding cylinder or cylinders it carries, and the collection and counter-cylinder that carries suitable closure counter supports or staple closers are selected so that the staple heads on the binding cylinders move essentially radially with respect to the axis of rotation of the collection and counter-cylinder.

DESCRIPTION OF THE PRIOR ART

It is generally well known to transversely cut a running web after the web has been printed. The cut web segments or signatures can be folded or can be collected and then folded. It is typical to utilize a cutting blade cylinder and a cooperating counter cut cylinder or collection cylinder provided with a plurality of axially extending cutting strips or bars to transversely cut the printed web. It is also generally known in the art to utilize stapling devices to insert staples through the signatures and to close these staples prior to effecting the folding of the signatures. The stapling or binding devices may be carried on the same cylinder which carries the cutting blades. The collection or counter-cylinder, which carries the cutting strips, can also be provided with closing dies or closure counter strips whose function is to close or bend over the staples once they have been inserted through the signatures by the stapling devices.

One prior art device is shown in German Patent Publication DE 29 32 757 02. This document describes a binding device in a folding apparatus of a rotary printing press. A combined cutting and binding cylinder is provided with die plates and with dies which are used to shape staples. These dies are moved by the utilization of a four bar linkage. Unfortunately, the four bar linkage does not move in an even, smooth fashion, due to the inherent nature of these types of linkage assemblies. It is thus possible for the four bar linkage to disrupt the smooth rotation of the binding cylinder as it moves and to thereby create possibly damaging vibrations in the binding cylinder.

A need exists for a binding or stapling device which overcomes the limitations of the prior art devices. The binding device in accordance with the present invention accomplishes that result and is a significant improvement over the prior art.

SUMMARY OF THE INVENTION

It is an object of the present invention to provide a binding device.

Another object of the present invention is to provide a device for binding or stapling signatures.

A further object of the present invention is to provide a device for binding signatures in a folding apparatus of a rotary press.

Yet another object of the present invention is to provide a binding device which utilizes one or more binding cylinders carried on a rotatable binding cylinder support.

Still a further object of the present invention is to provide a binding device having both binding cylinders and cutting cylinders rotatably supported on a rotatable cutting and binding cylinder support.

As will be discussed in detail in the description of the preferred embodiment which is presented subsequently, for binding cylinders in accordance with the present invention is utilized particularly in a folding apparatus of a rotary printing press. At least one binding cylinder, that carries a selected number of stapler heads, is rotatably supported on a binding cylinder support, which is itself supported for rotation. The stapler heads cooperate with a collection and counter-cylinder that is cooperatively positioned with respect to the rotatable binding cylinder support. The binding cylinder or cylinders rotate with, and with respect to, the rotatable binding cylinder support, which can also carry one or more cutting cylinders that carry cutters which cooperate with cutting strips situated on the surface of the collection and counter-cylinder.

A particular advantage of the binding device in accordance with the present invention is the smooth operation which results from its usage. Only rotating parts, such as the binding cylinders, the rotating cutting and binding cylinder support and the collection cylinder are used. Very little, if any, vibration is generated when the binding device in accordance with the present invention is in operation.

Another advantage of the present invention is its compactness The binding device does not require any additional structural space outside of a binding cylinder support and is constructed in a very compact, space efficient manner.

It will thus be seen that the binding device in accordance with the present invention overcomes the limitations of the prior art. It is substantial advance in the art.

BRIEF DESCRIPTION OF THE DRAWINGS

While the novel features of the binding device in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
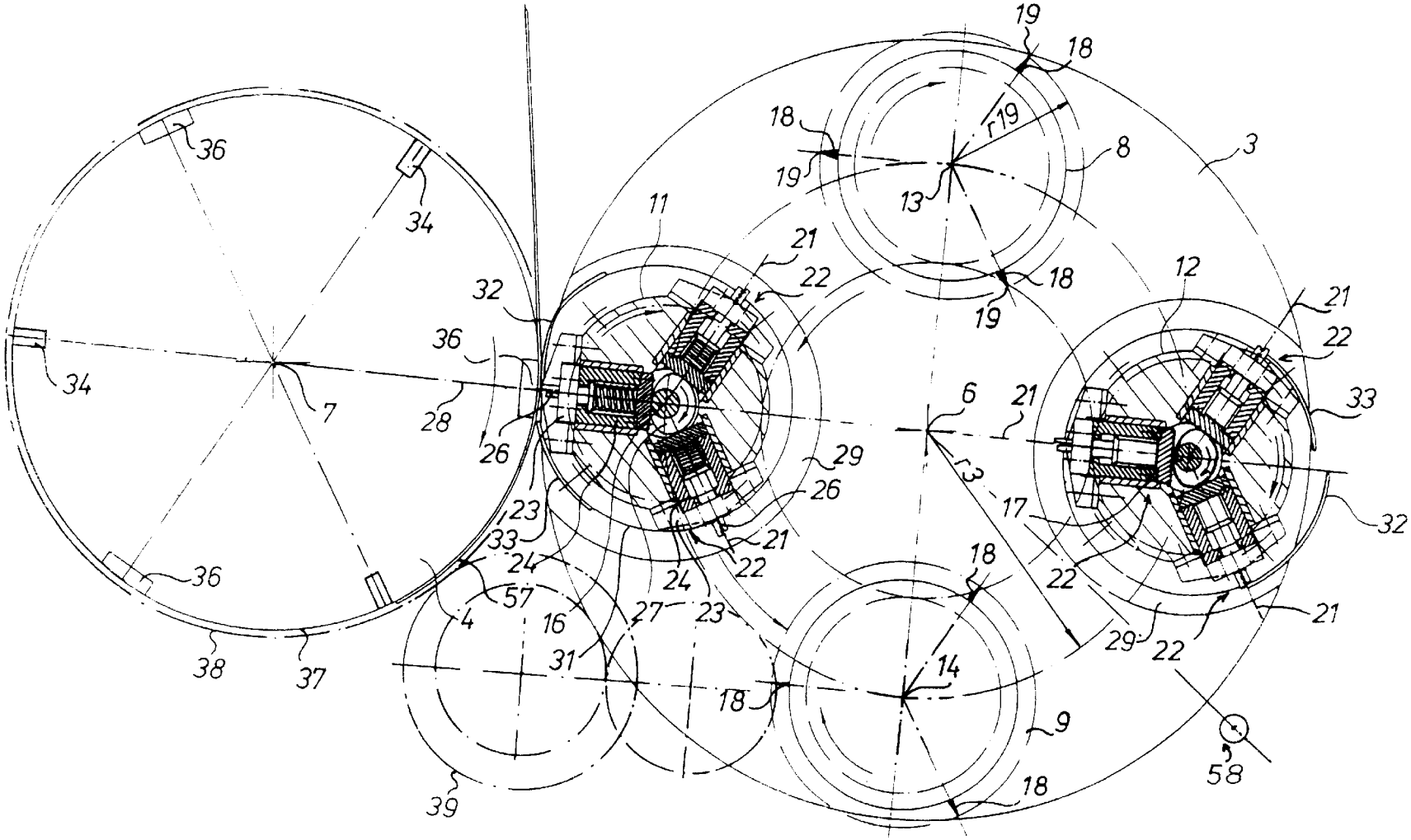
FIG. 1 is a schematic side elevation view of a binding device in accordance with the present invention.

Referring initially primarily to FIG. 1, there may be seen a binding device in accordance with the present invention. As discussed above, this binding device is typically a part of a folding apparatus and is located downstream, in a direction of travel of a printed web, from a web-fed rotary printing press. The overall folding apparatus and the web-fed rotary printing press do not form a part of the subject invention. Thus they are not shown in the drawings.

Figure 2:
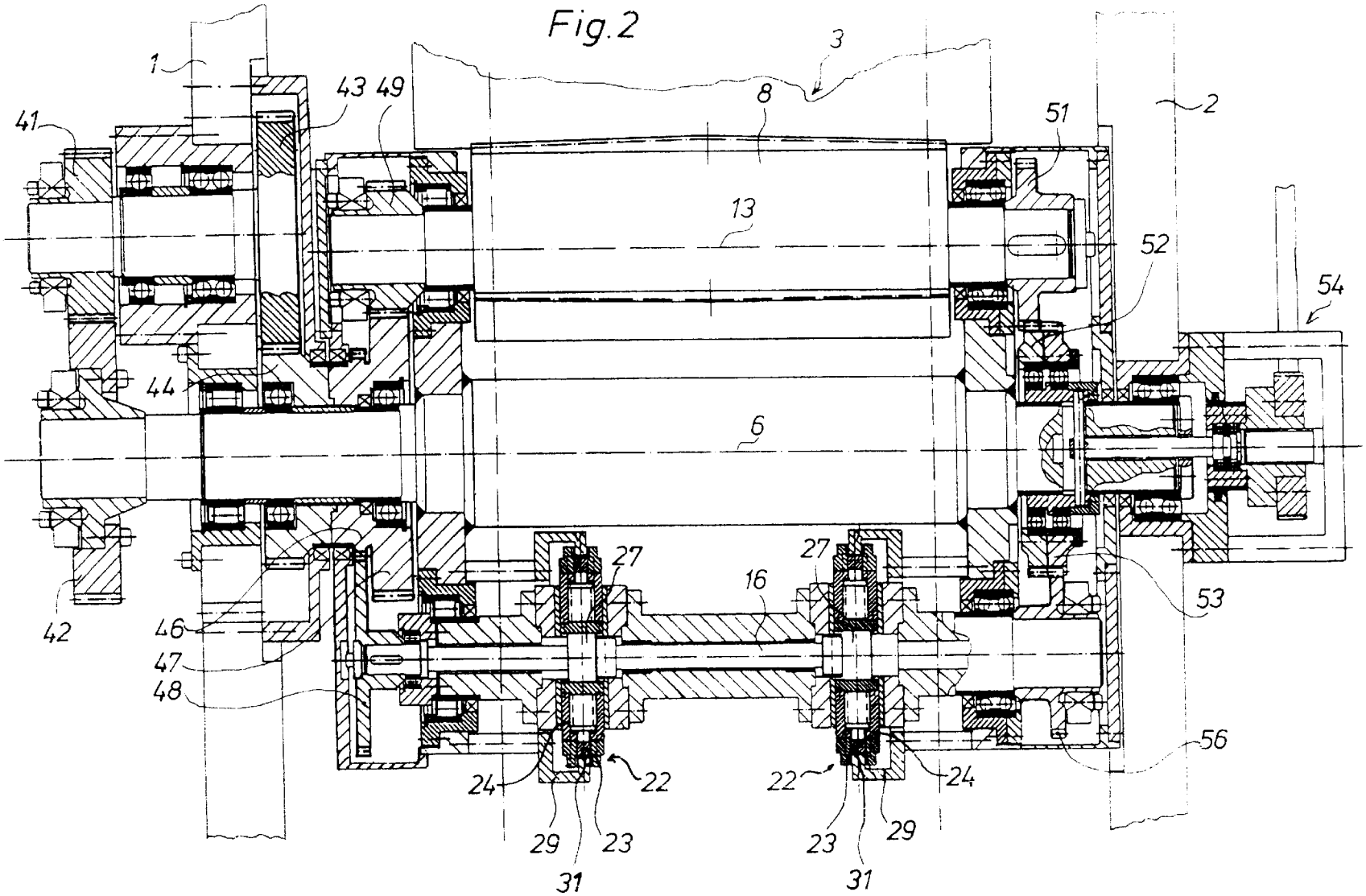
FIG. 2 is a cross-sectional view of the cutting and binding cylinder support of the present invention.

As may be seen most clearly in FIGS. 1 and 2, a rotatable cutting and binding cylinder support 3 and a collection and counter-cylinder 4 are seated for synchronous rotation around their respective axes of rotation 6 and 7, which extend parallel with each other, in side frames 1 and 2 of, for example, a folding apparatus of a rotary printing press. In the preferred embodiment as seen in FIGS. 1 and 2, the rotatable cutting and binding cylinder support 3 is provided with two rotatable cutting cylinders 8 and 9, and with two rotatable binding cylinders 11 and 12, whose respective axes of rotation 13, 14, 16, and 17 are disposed offset in pairs by 180° with respect to each other and are disposed concentrically at a radius r3 of, for example, r3=300 mm with respect to the axis of rotation 6 of the cutting and binding cylinder support 3. Each of the cutting and binding cylinders 8, 9, 11 and 12 is offset by 90° on the cutting and binding cylinder support 3 with respect to each adjacent cylinder 8, 9, 11 or 12. During a cutting and binding operation, the cutting and binding cylinder support 3 turns at the same time as, and synchronously with, the collection cylinder 4 during a cutting and binding operation. Three cutters 18 are fastened in each one of these cutting cylinders 8 and 9, and extend parallel with the axes of rotation 13 and 14 of the cutting cylinders 8 and 9. These cutters 18 are offset from each other by 120° and have cutting edges 19 which are disposed at a radius r19 of, for example, r19=150 mm, concentrically in respect to the axes of rotation 13 and 14 of the respective cutting cylinders 8 and 9. Thus, each cutting cylinder 8 and 9 carries three cutting blades 18 and each cutting cylinder 8 and 9 rotates with, as will as independently of, the rotatable cutting cylinder support 3. Both binding cylinders 11 and 12 are constructed in the some manner and thus only the binding cylinder 11 will be discussed in detail shortly. Three stapler planes 21 are provided on the binding cylinder 11 and are offset circumferentially by 120° with respect to each other. These stapler planes 21 each extend parallel to the axis of rotation of their respective binding cylinder. Each stapler plane 21 carries, in the preferred embodiment, two stapler heads 22 which are spaced in the axial direction of the stapler planes 21.

It will be understood that the collection cylinder 4 is shown as rotating in a clockwise direction and that the cutting and binding cylinder support 3 is shown as rotating in the counterclockwise direction, as indicated by the arrows interposed on each cylinder. Since these two elements are situated on opposing sides of a web to be cut and bound, these two cylinders are effectively both rotating in the same direction with respect to the two opposed surfaces of the web even though their direction of rotation about their respective axes 7 and 6 are opposite to each other. In a similar manner, the two cutting cylinders 8 and 9, and the two binding cylinders 11 and 12, which are carried by the cutting and binding cylinders support 3 are all rotating in a clockwise direction with respect to their respective axes of rotation 13, 14, 16 and 17. Event though cutting cylinders 8 and 9, binding cylinders 11 and 12, as well as collection and counter-cylinder 4 are all rotating in the clockwise direction, with respect to their individual axes of rotation, they are rotating in opposing directions with respect to the surface of the web to be cut and bound.

Each stapler head 22 essentially consists of a die 23, fixed in position in relation to the binding cylinders 11 or 12, and a spring-loaded, radially movable stapler piston 24. In their radially outward pointing ends, all of the stapler pistons 24 are provided with two cutting and guidance elements 26. A camshaft 27 acts on an inwardly facing end of the stapler piston 24. This camshaft 27 is seated in the center of the binding cylinder 11 and rotates at a speed n27, which corresponds to the exact speed n3 or to a whole number multiple of the speed n3 of the cutting and binding cylinder support 3. The camshaft 27 is designed in such a way that the stapler piston 24 is extended during the transfer of the bonding wire to it and, after the completion of binding; i.e. when the piston 24 is aligned on a center line 28 of the cutting and binding cylinder support 3 and the collection cylinder 4, the piston 24 is completely retracted. A bending horn 29, which, for example, may be eccentric,is disposed around the binding cylinders 11 and 12 in the interior of the cutting and binding cylinder support 3 in the area of the stapler heads 22. A distance between an inner surface 31 of the bending horn 29, which extends parallel with the axis of rotation 16 of the binding cylinder 11, and the axis of rotation of the bonding cylinder 11 initially becomes less in the direction of rotation of the bonding cylinder 11 due to the eccentricity of the bending horn, and then returns to a maximum. This may be accomplished, for example, by means of an eccentric placement of the bending horn 29, which may be shaped as a hollow cylinder and a section of a circle, or by means of a hectically designed inner surface 31 of the bending horn 29. Outside of the surface of the cutting and binding cylinder 3, the bending horn 29 continues at each end to form two flexible plates 32, 33. These two flexible plates 32, 33 form merely a narrow gap at their ends facing each other.

The collection cylinder 4 is used as the counter-cylinder for the cutting and binding cylinders 8, 9, 11 and 12 and is therefore provided with cutting strips 34, fixed on the cylinder and with closure counter-supports 36, also fixed in place on the cylinder. Three cutting strips 34, offset from each other by 120°, have been cut immovably and congruently with a surface 37 of the collection cylinder 4 at a radius r4 of, for example, r4=300 mm, concentrically with respect to the axis of rotation 7 of the collection cylinder 4. These three cutting strips 34 on the surface 37 the collection and counter-cylinder 4 are generally conventional and cooperate with the individual cutting blades 18 that are situated on the surface of the cutting cylinders 8 and 9 to transversely cut or sever the web as it passes between the cooperating cutting cylinder 8 or 9 and the collection and counter-cylinder 4. The closure-counter supports 36 are also generally conventional and cooperate with the individual stapler head dies 23 to staple the web. The cutting strips 34 and the closure counter-strips 36 are offset from each other by 60° about the surface 37 of the collection and counter-cylinder 4, as may be seen in FIG. 1.

Referring now primarily to FIG.2, the driving of the cutting cylinders 8 and 9, and the binding cylinders 11 and 12 is performed by means of a planetary toothed wheel gear which originates from a main toothed wheel drive train. The collection cylinder 4 has a collection cylinder gear wheel 38 with a number of teeth, for example 132, and which is driven by a drive apparatus, not shown. A first intermediate gear wheel 39 is seated in the side frame 1 and is provided with a number of teeth, for example 64. First intermediate gear wheel 39 meshes with this gear wheel 38 of the collection cylinder 4 in order to drive the cutting and binding cylinder support 3, and in turn, it cooperates with a second intermediate gear wheel 41, that is seated in the side frame 1, and that is provided with a number of teeth, for example 64. This second intermediate gear wheel 41 rolls off against a cutting and binding cylinder support drive gear wheel 42 with a number of teeth, for example 88, of the cutting and binding cylinder support 3, because of which the cutting and binding cylinder support 3 is driven and rotates at a speed n3.

A cutting and binding cylinder main drive gear wheel 43 with a number of teeth, for example 39, is connected with the second intermediate gear wheel 41, and meshes with a freely rotatable gear wheel 44, which is seated freely rotatable and concentrically with the axis of rotation 6 of the cutting and binding cylinder support 3, with a number of teeth, for example 33. Two sun gear wheels 46 and 47 with external teeth with a number of teeth, for example 96, are connected with this freely rotatable gear wheel 44. A first planetary gear wheel 48 and with a number of teeth, for example 60, meshes with the first sun gear 46. This first planetary gear wheel 48, as may be seen in FIG. 2, is secured on an end of the camshaft 27 of each of the respective binding cylinders 11 and 12. A second similar planetary gear wheel 49 with a number of gear teeth, for example 36 meshes with the second sun gear 47. This second planetary gear wheel 49 is secured to each of the respective cutting cylinders 8 and 9.

A third planetary gear wheel 51 with helical teeth and with a number of teeth, for example 52, is fastened on each of the cutting cylinders 8 and 9 on the opposite side of the cutting cylinders 8 and 9, and which engages a freely rotatable sun gear wheel 52 with helical teeth and with a number of teeth, for example 78, which is seated concentrically with the axis of rotation 6 of the cutting and binding cylinder support 3. This freely rotational sun gear wheel 52 is fixedly connected with a second sun gear wheel 53 with helical teeth and with a number of teeth, for example 78, and both sun gear wheels 52 and 53, are axially displaceable together by means of an actuating drive 54. The second sun gear wheel 53 rolls off on a fourth planetary gear wheel 56 with a number of teeth, for example 52, of each of the respective binding cylinder 11 and 12, because of which the binding cylinder 11 and 12 each rotate at a speed n11. The gradients of the teeth of the sun or planetary gear wheels 52 and 51 of the cutting cylinders 8 and 9 are unequal to the gradients of the sun or planetary gear wheels 53 and 54 of the binding cylinders 11 and 12, so that it is possible to provide a phase shift between the cutting cylinders 8 and 9, and the binding cylinders 11 and 12. It is thus possible because of this to match the binding to a bottom or a top fold.

The cutting strips 34 or the closure counter-supports 36 of the collection cylinder 4 cooperate with the cutters 18 of the two cutting cylinders and 8 and 9 or with the stapler heads 22 of the two binding cylinders 11 and 12. A speed n3 of the cutting and binding cylinder support 3 must be 1.5 times the speed n4 of the collection cylinder 4: i.e. $n3=1.5\times n4$. In order to obtain an approximately radial alignment of the cutters 18 or the stapler heads 22 with respect to the collection cylinder 4 during cutting or binding, the speed n8 of the cutting cylinders 8 and 9 or a speed n11 of the binding cylinders 11 and 12 is a sum of the amount of the speed n3 of the cutting and binding cylinder support 3 plus an amount of the speed n4 of the collection cylinder 4; i.e. $n8=|n3|+|n4|$. With the executed radii r3, r4 and r19, an approximately equal circumferential speed of the cutters 19 or stapler heads 22 and the cutting strip 34 or of the closure counter-supports 36 results during cutting.

A conventional stapler wire supply device 58, which is shown schematically in FIG. 1, is arranged offset by 144° in the direction of rotation of the cutting and binding cylinder support 3 with respect to the center line 28 of the cutting and binding cylinder support 3 and the collection cylinder 4 at the periphery of the cutting and binding cylinder support 3. At this point, the stapler head 22, which will perform the next binding operation, has the greatest distance from the axis of rotation 6 of the cutting and binding cylinder support 3; i.e. the stapler head 22, the axes of rotation 16 and 17 of the bonding cylinders 11 or 12 and the axis of rotation 6 of the cutting and binding cylinder support 3 are located on a common straight line. A raised area of the camshaft 27 presses cutting and guidance elements 26 out against a spring force until the corresponding maximally occurring radius of the cutters 18 has been exceeded. In this way, a U-shaped die mold for forming a staple is formed by the fixed die 23 and by the extending cutting and guidance elements 26. A staple wire is fed to the cutting and guidance elements 26 of the stapler head 22 and is subsequently cut off by the continuing rotating movement of the cutting and binding cylinder support 3. Immediately after the cut has been made, the cut staple wire is moved underneath the first flexible plate 32, as viewed in the direction of rotation, by the continuing rotating movement of the binding cylinder 11 or 12. The staple wire is thereby fixed in the cutting and guidance elements 26. The staple wire is then brought into the area of the bending horn 29 by the further rotating movement of the binding cylinder 11 or 12 with the stapler heads 22. Because of the decreasing distance of the inner surface 31 of the bending horn 29 with respect to the axis of rotation 16 of the binding cylinder 11, the staple wire is pressed into the U-shaped die formed by the die 23 and the cutting and guidance elements 26, and is formed into a staple in the course of the rotating movement of the binding cylinder 11. The shaping of the staple is finished no later than its exit from the bending horn 29, and in the instant example, is finished after a rotating movement of approximately 180° of the stapler head 22 in the bending horn 29. Until this time at least, the raised portion of the camshaft 27 presses the stapler piston 24 with the cutting and guidance elements 26 outward. Subsequently, the shaped staple is held by the second flexible plate 33 which extends from the bending horn 29 in the direction of rotation. The cam shaft 27 rotates from its raised area to its low area with respect to the stapler piston 24. In the process, the stapler piston 24 with the cutting and guidance elements 26, moves radially inward and partially releases the staple legs of the staple. No later than shortly prior to the meeting between the staple legs with the product elements 57, the corresponding stapler heads 22, and therefore also the staples, are placed radially in relation to the axis of rotation 7 of the collection cylinder 4.

Figure 3:
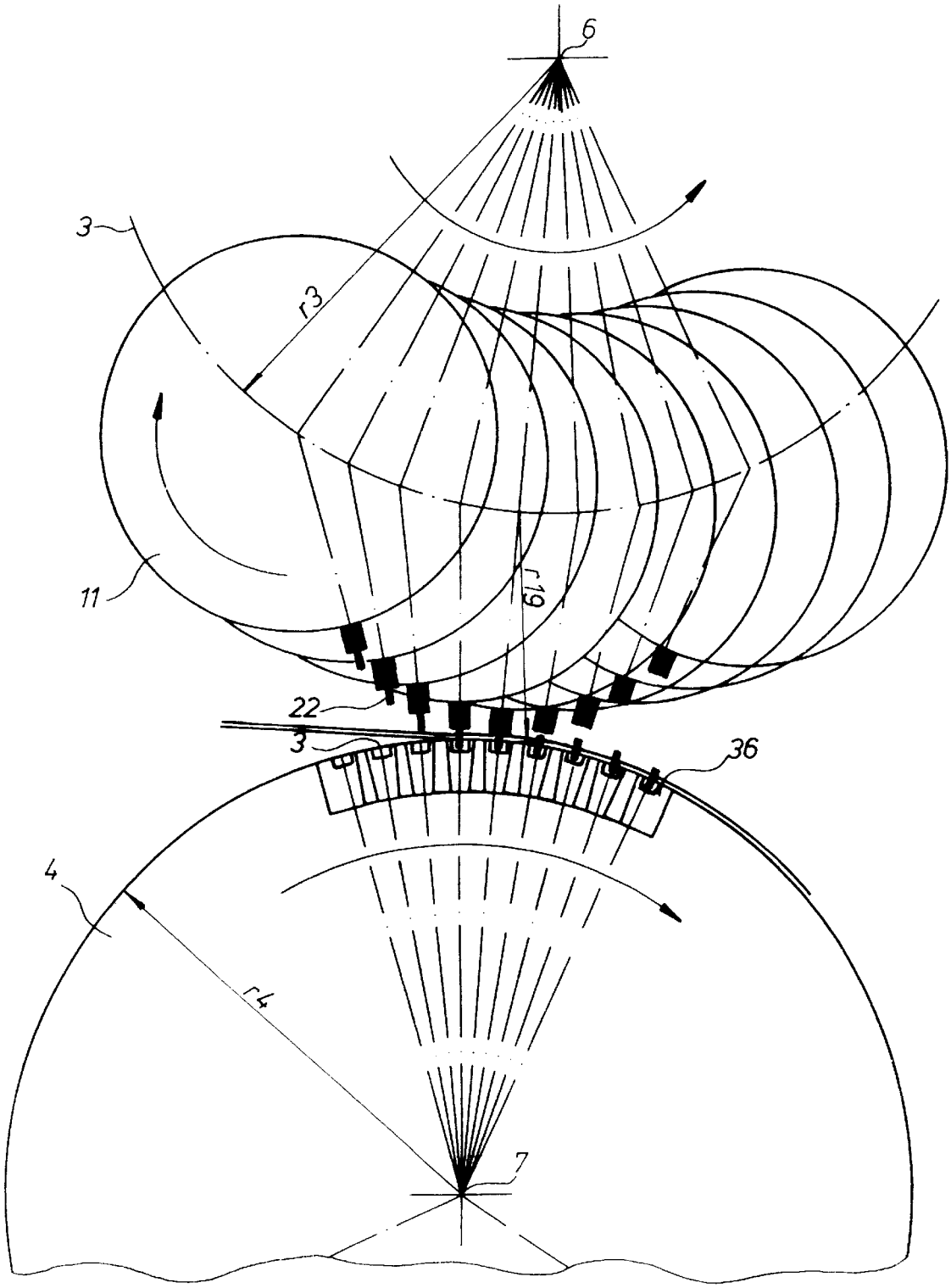
FIG. 3 is a schematic depiction of an enlarged portion of the cutting and binding cylinder support in cooperation with the collection and counter-cylinder during a movement cycle of the binding device of the present invention.

Referring now to FIG. 3, the entire binding movement is performed radially with respect to the axis of rotation 7 of the collection cylinder 4 because of the superimposed rotating movements of the binding cylinders 11 and 12 and of the cutting and binding cylinder support 3. Due to the rotating movement of the cutting and binding cylinder support 3, the staple is pushed into the product elements 57 by means of the free-standing dies 23 acting on the back of the staple. As soon as the staple has moved through the product elements 57, the cutting and guidance elements 26 are completely retracted and the staple leaves the second flexible plate 33. The staple penetrates the product elements 57 and is closed by the closure counter-supports 36, which may be provided with oat-grain-shaped depressions, for example.

To perform the above-described binding process, the binding cylinders 11 and 12 and therefore the stapler heads 22 rotate around their responsive axes of rotation 16 and 17. This rotating movement is performed by the previously described driving device in such a way that the respective stapler head 22 involved in the actual binding process performs an approximately radial movement directed on the axis of rotation 7 of the collection cylinder 4 from the start to the end of the binding operation; i.e. from the time of meeting the product elements 57 to the time of lifting off the product elements 57. In the course of this both the respective stapler heads 22 and the corresponding closure counter-supports 36 move at approximately the speed of the web. This essentially radial movement of the stapler heads 22 and their cooperating closure counter supports 36 during the course of insertion of the staples through the product elements 57 promotes the smooth, efficient operation of the binding device in accordance with the present invention, with less wear and vibration.

It is also possible, in accordance with the present invention, to use other drive devices than the described planetary gears for performing the rotating movement of the cutting and binding cylinders 8, 9, 11 and 12. For example, it is conceivable to directly rotate the cutting and binding cylinders 8, 9, 11 and 12 by means of electric or hydraulic motors that would be synchronized with the cutting and binding cylinder support 3. It is, of course, also possible to seat the binding cylinders 11 and 12 separately from the cutting cylinders 8 and 9 in their own rotating binding cylinder support. The device in accordance with the present invention is not limited to the depicted embodiment with a three-piece collection cylinder 4 shown, but can also be adapted to other cutting and binding devices with, for example, five-or seven-piece collection cylinders.

While a preferred embodiment of a binding device in accordance with the present invention has been set forth fully and completely hereinabove, it will be apparent to one of skill in the art that a number of changes in, for example, the particular folding apparatus, the type of rotary printing press, the type of web being printed and the like may be made without departing from the true spirit and scope of the present invention which is accordingly to be limited only by the following claims.

What is claimed is:

1. A binding device usable for binding signatures in a folding apparatus of a rotary printing press comprising:

a collection and counter-cylinder having a plurality of fixed closure counter supports positioned on a peripheral surface of said collection and counter-cylinder, said collection and counter-cylinder being supporting for rotation;

at least one binding cylinder having a plurality of stapler heads, with each of said stapler heads being engageable with a cooperating one of said closure counter supports;

a binding cylinder support cooperatively positioned with respect to said collection and counter-cylinder, said binding cylinder support being rotatable at a first speed, said at least one binding cylinder being rotatably supported on said binding cylinder support for rotation with, and with respect to said binding cylinder support; and a plurality of bending horns on said binding cylinder support, said plurality of bending horns being positioned in an interior portion of said binding cylinder support and cooperating with said at least one binding cylinder.

2. The binding device of claim 1 wherein said at least one binding cylinder is rotatably supported on said binding cylinder support for rotation about a binding cylinder axis of rotation and further wherein said binding cylinder support is rotatable about a binding cylinder support axis of rotation, said binding cylinder axis of rotation and said binding cylinder support axis of rotation being arranged concentrically with respect to each other.

3. The binding device of claim 1 wherein each of said bending horns has an interior surface which extends generally parallel with and axis of rotation of said at least one binding cylinder and further wherein a distance of said interior surface of said bending horn with respect to said axis of rotation of said at least on binding cylinder is reduced in a direction of rotation of said at least one binding cylinder.

4. The binding device of claim 1 wherein each of said bending horns is a hollow, cylinder-shaped segment of a circle and further wherein said segment of a circle is disposed eccentrically with respect to an axis of rotation of said at least one binding cylinder.

5. The binding device of claim 1 wherein each of said bending horns has an interior surface and further wherein said interior surface is disposed hectically with respect to an axis of rotation of said at least one binding cylinder.

* * * * *